US007862667B2

(12) United States Patent
Turconi et al.

(10) Patent No.: US 7,862,667 B2
(45) Date of Patent: Jan. 4, 2011

(54) STEELS FOR SOUR SERVICE ENVIRONMENTS

(75) Inventors: Gustavo López Turconi, Buenos Aries (AR); Alfonso Izquierdo Garcia, Veracruz (MX); Toshihiko Fukui, Kawasaki (JP)

(73) Assignee: Tenaris Connections Limited, Kingstown (VC)

( * ) Notice: Subject to any disclaimer, the term of this patent is extended or adjusted under 35 U.S.C. 154(b) by 0 days.

(21) Appl. No.: 12/042,145

(22) Filed: Mar. 4, 2008

(65) Prior Publication Data

US 2009/0010794 A1 Jan. 8, 2009

Related U.S. Application Data

(60) Provisional application No. 60/948,418, filed on Jul. 6, 2007.

(51) Int. Cl.
*C22C 38/44* (2006.01)
*C22C 38/48* (2006.01)
*C22C 38/50* (2006.01)

(52) U.S. Cl. ..... 148/333; 148/320; 148/330; 148/332; 148/334

(58) Field of Classification Search ..... 148/320, 148/330, 332–334, 909, 590, 593, 654, 663; 420/104–111, 114
See application file for complete search history.

(56) References Cited

U.S. PATENT DOCUMENTS 4,407,681 A * 10/1983 Ina et al. ..... 148/570
6,267,828 B1 7/2001 Kushida et al.
6,958,099 B2 10/2005 Nakamura et al.
7,074,283 B2 7/2006 Omura
7,264,684 B2 9/2007 Numata et al.
2007/0137736 A1 6/2007 Omura et al.

FOREIGN PATENT DOCUMENTS

| | | | |
|---|---|---|---|
| EP | 0 828 007 A | | 3/1998 |
| EP | 1 008 660 A | | 6/2000 |
| JP | 60-86209 | * | 5/1985 |
| JP | 61-270355 | * | 11/1986 |
| JP | 63004046 A2 | | 1/1988 |
| JP | 63004047 A2 | | 1/1988 |
| JP | 63230847 A2 | | 9/1988 |
| JP | 63230851 A2 | | 9/1988 |
| JP | 01 259124 A2 | | 10/1989 |
| JP | 01 259125 A2 | | 10/1989 |
| JP | 01 283322 A2 | | 11/1989 |

(Continued)

OTHER PUBLICATIONS

Written Opinion and International Search Report dated May 20, 2009 for corresponding PCT application No. PCT/IB2008;/003710.

(Continued)

*Primary Examiner*—Deborah Yee
(74) *Attorney, Agent, or Firm*—Knobbe Martens Olson & Bear, LLP

(57) ABSTRACT

Embodiments of the present application are directed towards steel compositions that provide improved properties under corrosive environments. Embodiments also relate to protection on the surface of the steel, reducing the permeation of hydrogen. Good process control, in terms of heat treatment working window and resistance to surface oxidation at rolling temperature, are further provided.

19 Claims, 4 Drawing Sheets

FOREIGN PATENT DOCUMENTS

| | | | |
|---|---|---|---|
| JP | 04 021718 | A2 | 1/1992 |
| JP | 04 231414 | A2 | 8/1992 |
| JP | 05 287381 | A2 | 11/1993 |
| JP | 06 172859 | A2 | 6/1994 |
| JP | 07 041856 | A2 | 2/1995 |
| JP | 07 197125 | A2 | 8/1995 |
| JP | 09 067624 | A2 | 3/1997 |
| JP | 10 280037 | A | 10/1998 |
| JP | 11 050148 | A | 2/1999 |
| JP | 2000-063940 | | 2/2000 |
| JP | 2000-313919 | A2 | 11/2000 |
| JP | 2001-131698 | | 5/2001 |
| JP | 2001-131698 | A | 5/2001 |
| JP | 2001-172739 | A2 | 6/2001 |
| JP | 2001-271134 | | 10/2001 |
| JP | 2002-096105 | A2 | 4/2002 |
| WO | WO 2009/044297 | A3 | 4/2009 |

OTHER PUBLICATIONS

Berner, Robert A., "Tetragonal Iron Sulfide", *Science*, Aug. 31, 1962, vol. 137, Issue 3531, pp. 669.

Berstein et al.,"The Role of Traps in the Microstructural Control of Hydrogen Embrittlement of Steels" *Hydrogen Degradation of Ferrous Alloys*, Ed. T. Oriani, J. Hirth, and M. Smialowski, Noyes Publications, 1988, pp. 641-685.

Boulegue, Jacques, "Equilibria in a sulfide rich water from Enghien-les-Bains, France", *Geochimica et Cosmochimica Acta*, Pergamon Press, 1977, vol. 41, pp. 1751-1758.

Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.

Cancio et al., "Characterisation of microalloy precipitates in the austenitic range of high strength low alloy steels", *Steel Research*, 2002, vol. 73, pp. 340-346.

Clark, A. Horrell, "Some Comments on the Composition and Stability Relations of Mackinawite," *Neues Jahrbuch f r Mineralogie*, 1966, vol. 5, pp. 300-304, London, England.

Craig, Bruce D., "Effect of Copper on the Protectiveness of Iron Sulfide Films", *Corrosion*, National Association of Corrosion Engineers, 1984, vol. 40, Issue 9, pp. 471-474.

De Medicis, "Cubic FeS, A Metastable Iron Sulfide", *Science*, 1970, vol. 170, Issue 3963 pp. 1191-1192.

Echaniz, "The effect of microstructure on the KISSC of low alloy carbon steels", Nace Corrosion '98, EE. UU., Mar. 1998, pp. 22-27, San Diego.

Echaniz, G., Morales, C., Perez, T., "The effect of microstruction on the KISSC of low alloy carbon steels," *Advances in Corrosion Control and Materials in Oil and Gas Production* Papers from Eurocorr 97 and Eurocorr 98, 13, P. S. Jackman and L.M. Smith, Published for the European Federation of Corrosion, No. 26, European Federation of Corrosion Publications, 1999.

Gojié, Mirko and Kosec, Ladislav, , "The Susceptibility to the Hydrogen Embrittlement of Low Alloy Cr and CrMo Steels", *ISIJ International*, 1997, vol. 37, Issue 4, pp. 412-418.

Hutchings et al., "Ratio of Specimen thickness to charging area for reliable hydrogen permeation measurement", *British Corrosion Journal*, 1993, vol. 28, Issue 4, pp. 309-312.

Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.

Jacobs, Lucinda and Emerson, Steven, "Trace Metal Solubility in an Anoxid Fjord", *Earth and Planetary Sci. Letters*, 1982, vol. 60, pp. 237-252.

Keizer, Joel, "Statistical Thermodynamics of Nonequilibrium Processes", Spinger-Verlag, 1987.

Korolev, D. F., "The Role of Iron Sulfides in the Accumulation of Molybdenum in Sedimentary Rocks of the Reduced Zone", *Geochemistry*, 1958, vol. 4, pp. 452-463.

Lee, S.M. and Lee, J.Y., "The Effect of the Interface Character of TiC Particles on Hydrogen Trapping in Steel", *Acta Metall.*, 1987, vol. 35, Issue 11, pp. 2695-2700.

Mishael, et al., "Practical Applications of Hydrogen Permeation Monitoring," *Corrosion*, Mar. 28-Apr. 1, 2004.

Morice et al., "Mössbauer Studies of Iron Sulphides", *J. lnorg. Nucl. Chem.*, 1969, vol. 31, pp. 3797-3802.

Mullet et al., "Surface Chemistry and Structural Properties of Mackinawite Prepared by Reaction of Sulfide Ions with Metallic Iron", *Geochemica et Cosmochemica Acta*, 2002, vol. 66, Issue 5, pp. 829-836.

Murowchick, James B. and Barnes, H.L., "Formation of a cubic FeS", *American Mineralogist*, 1986, vol. 71, pp. 1243-1246.

Nakai et al., "Development of Steels Resistant to Hydrogen Induced Cracking in Wet Hydrogen Sulfide Environment", *Transactions of the ISIJ*, 1979, vol. 19, pp. 401-410.

Rickard, D.T., "The Chemistry of Iron Sulphide Formation at Low Tempuratures", *Stockholm Contrib. Geol.*, 1969, vol. 26, pp. 67-95.

Riecke, Ernst and Bohnenkamp, Konrad, "Uber den Einfluss von Gittersoerstellen in Eisen auf die Wassersroffdiffusion", *Z. Metall.*, 1984, vol. 75, pp. 76-81.

Shanabarger, M.R. and Moorhead, R. Dale, "$H_2O$ Adsorption onto clean oxygen covered iron films" , *Surface Science*, 1996, vol. 365, pp. 614-624.

Shoesmith, et al., "Formation of Ferrous Monosulfide Polymorphs During Corrosion of Iron by Aqueous Hydrogen Sulfide at 21° C.", *J. Electrochem. Soc.*, 1980, vol. 127, Issue 5, pp. 1007-1015.

Spry, Alan, "Metamorphic Textures" , Pergamon Press, 1969, New York.

Taira et al., "HIC and SSC Resistance of Line Pipes for Sour Gas Service", *Nippon Kokan Technical Report*, 1981, vol. 31, Issue 1-13.

Taira et al., "Study on the Evaluation of Environmental Condition of Wet Sour Gas", *Corrosion 83* (Reprint. No. 156, National Association of Corrosion Engineers), 1983, pp. 156/1-156/13, Houston, Texas.

Takeno et al., "Metastable Cubic Iron Sulfide—With Special Reference to Mackinawite", *American Mineralogist*, 1970, vol. 55, pp. 1639-1649.

Vaughan, D. J. and Ridout, M.S., "Mössbauer Studies of Some Sulphide Minerals", *J. lnorg. Nucl. Chem.*, 1971, vol. 33, pp. 741-746.

* cited by examiner

STEELS FOR SOUR SERVICE ENVIRONMENTS

CROSS-REFERENCE TO RELATED APPLICATIONS

This application claims the benefit of priority under 35 U.S.C. §119(e) of U.S. Provisional Application No. 60/948,418 filed on Jul. 6, 2007, entitled "Steels for Sour Service Environments", the entirety of which is incorporated herein by reference.

BACKGROUND OF THE INVENTION

1. Field of the Invention

Embodiments of the present disclosure are directed towards steel compositions that provide good toughness under corrosive environments. Embodiments also relate to protection on the surface of the steel, reducing the permeation of hydrogen. Good process control, in terms of the heat treatment working window and resistance to surface oxidation at rolling temperature, are further provided.

2.Description of the Related Art

The insertion of hydrogen into metals has been extensively investigated with relation to energy storage, as well as the degradation of transition metals, such as spalling, hydrogen embrittlement, cracking and corrosion. The hydrogen concentration in metals, such as steels, may be influenced by the corrosion rate of the steel, the protectiveness of corrosive films formed on the steel, and the diffusivity of the hydrogen through the steel. Hydrogen mobility inside the steel is further influenced by microstructure, including the type and quantity of precipitates, grain borders, and dislocation density. Thus, the amount of absorbed hydrogen not only depends on the hydrogen-microstructure interaction but also on the protectiveness of the corrosion products formed.

Hydrogen absorption may also be enhanced in the presence of absorbed catalytic poison species, such as hydrogen sulfide ($H_2S$). While this phenomenon is not well understood, it is of significance for High Strength Low Alloy Steels (HSLAs) used in oil extraction. The combination of high strength in the steels and large quantities of hydrogen in $H_2S$ environments can lead to catastrophic failures of these steels.

From the forgoing, then, there is a continued need for steel compositions which provide improved resistance to corrosion in aggressive environments, such as those containing $H_2S$.

SUMMARY OF THE INVENTION

Embodiments of the present application are directed towards steel compositions that provide improved properties under corrosive environments. Embodiments also relate to protection on the surface of the steel, reducing the permeation of hydrogen. Good process control, in terms of heat treatment working window and resistance to surface oxidation at rolling temperature, are further provided.

In one embodiment, the present disclosure provides a steel composition comprising:

carbon (C) between about 0.2 and 0.3 wt. %;
manganese (Mn) between about 0.1 and 1 wt. %;
silicon (Si) between about 0 and 0.5 wt. %;
chromium (Cr) between about 0.4 and 1.5 wt. %;
molybdenum (Mo) between about 0.1 and 1 wt. %;
niobium (Nb) between about 0 and 0.1 wt. %;
aluminum (Al) between about 0 and 0.1 wt. %;
calcium (Ca) between about 0 and 0.01 wt. %;

boron (B) less than about 100 ppm;
titanium (Ti) between about 0 and 0.05 wt. %;
tungsten (W) between about 0.1 and 1.5 wt. %;
vanadium (V) between about 0 and no more than about 0.05 wt. %;
copper (Cu) between about 0 and no more than about 0.15 wt. %;
oxygen (O) less than about 200 ppm;
nitrogen (N) less than about 0.01 wt. %;
sulfur (S) less than about 0.003 wt. %; and
phosphorus (P) less than about 0.015 wt. %.

It will be appreciated that in another embodiment, not all of the elements listed above need be present in the steel composition, and other compositions are contemplated which may be utilized for sour service. In one embodiment, such a steel may comprise the following composition:

carbon (C) between about 0.2 and 0.3 wt. %;
manganese (Mn) between about 0.1 and 1 wt. %
chromium (Cr) between about 0.4 and 1.5 wt. %;
silicon (Si) between about 0.15 and 0.5 wt. %;
molybdenum (Mo) between about 0.1 and 1 wt. %;
tungsten (W) between about 0.1 and 1.5 wt. %;
niobium (Nb) between about 0 and 0.1 wt. %; and
boron (B) less than about 100 ppm.

In another embodiment, a steel composition is provided comprising carbon (C), molybdenum (Mo), chromium (Cr), tungsten (W), niobium (Nb), and boron (B). The amount of each of the elements is provided, in wt. % of the total steel composition, such that the steel composition satisfies the formula: Mo/10+Cr/12+W/25+Nb/3+25*B between about 0.05 and 0.39 wt. %.

In another embodiment, the sulfur stress corrosion (SSC) resistance of the composition is about 720 h as determined by testing in accordance with NACE TM0177, test Method A, at stresses of about 85% Specified Minimum Yield Strength (SMYS) for full size specimens.

In another embodiment, the steel composition further exhibits a substantially linear relationship between mode I sulfide stress corrosion cracking toughness ($K_{ISSC}$) and yield strength.

In further embodiments, the steel compositions are formed into pipes.

DETAILED DESCRIPTION OF CERTAIN EMBODIMENTS

Figure 1:
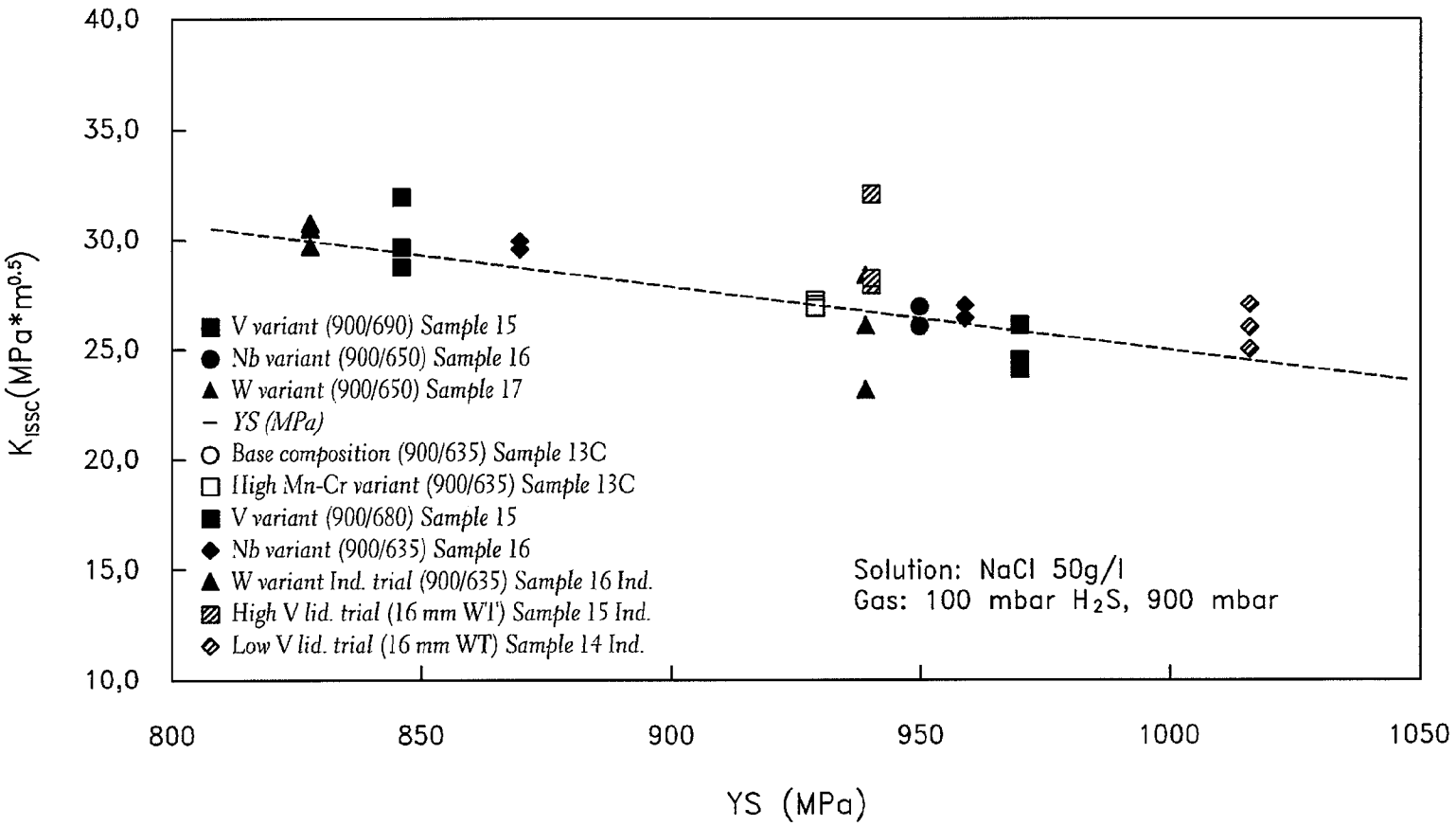
FIG. 1 presents mode I sulfide stress corrosion cracking toughness ($K_{ISSC}$) values as a function of yield strength for embodiments of the disclosed steel compositions.

Embodiments of the disclosure provide steel compositions for sour service environments. Properties of interest include, but are not limited to, hardenability, microstructure, precipitate geometry, hardness, yield strength, toughness, corrosion resistance, sulfide stress corrosion cracking resistance (SSC), the formation of protective layers against hydrogen diffusion, and oxidation resistance at high temperature.

In certain embodiments, a substantially linear relation between mode I sulfide stress corrosion cracking toughness ($K_{ISSC}$) and yield strength (YS) has also been discovered for embodiments of the composition having selected microstructural parameters. The microstructural parameters may include, but are not limited to, grain refinement, martensite packet size, and the shape and distribution of precipitates.

In other embodiments, it has been further discovered that there exists a particular relation among the following microstructural parameters which leads to this relationship:

Average Packet Size, $d_{packet}$, less than about 3 μm.

Precipitates having a particle diameter, $d_p$ greater than about 70 nm and a shape factor greater or equal to about 0.62, as discussed below.

Microstructures possessing martensite in a volume fraction of higher than about 95. vol. % on the basis of the total volume of the steel composition.

It has been additionally discovered that embodiments of the steel compositions possessing these microstructural parameters within the selected ranges may also provide additional benefits. For example, the steel compositions may exhibit improved corrosion resistance in sour environments and as well as improved process control.

In certain embodiments, these improvements are provided by the addition or limitation of selected elements, as follows:

Addition of tungsten (W) diminishes oxidation of the steel when heated within atmospheres typically formed in combustion furnaces used in hot rolling processes.

Limitation of maximum copper (Cu) content inhibits the hydrogen permeability of the steel through the formation of an adherent corrosion product layer.

Oxygen (O) inhibits the formation of oversized inclusions within the steel, providing isolated inclusion particles which are less than about 50 μm in size. This inhibition of inclusions further inhibits the formation of nucleation sites for hydrogen cracking.

Low vanadium (V) content lessens the steepness of the tempering curve (yield strength vs. tempering temperature), which improves process control capability.

In certain embodiments, steel compositions which comprise W, low Cu, and low V and further exhibit the microstructure, packet size, and precipitate shape and size discussed above have also been discovered. These compositions are listed below in Table 1, on the basis of wt. % of the total composition unless otherwise noted. It will be appreciated that not every element listed below need be included in every steel composition, and therefore, variations including some, but not all, of the listed elements are contemplated.

Carbon (C)

Carbon is an element which improves the hardenability of the steel and further promotes high strength levels after quenching and tempering.

In one embodiment, if the amount of C is less than about 0.15 wt. %, the hardenability of the steel becomes too low and strength of the steel cannot be elevated to desired levels. On the other hand, if the C content exceeds about 0.40%, quench cracking and delayed fracture tend to occur, complicating the manufacture of seamless steel pipes. Therefore, in one embodiment, the C content ranges between about 0.20-0.30 wt. %.

Manganese (Mn)

Addition of manganese to the steel contributes to deoxidization and desulphurization. In one embodiment, Mn may be added in a quantity not less than about 0.1. wt. % in order to obtain these positive effects. Furthermore, Mn addition also improves hardenability and strength. High Mn concentrations, however, promote segregation of phosphorus, sulfur, and other tramp/impurity elements which can deteriorate the sulfide stress corrosion (SSC) cracking resistance. Thus, in one embodiment, manganese content ranges between about 0.10 to 1.00 wt. %. In a preferred embodiment, Mn content ranges between about 0.20 to 0.50 wt. %.

Chromium (Cr)

Addition of chromium to the steel increases strength and tempering resistance, as chromium improves hardenability during quenching and forms carbides during tempering treatment. For this purpose, greater than about 0.4 wt. % Cr is added, in one embodiment. However, in certain embodiments, if Cr is provided in a concentration greater than about 1.5 wt. %, its effect is saturated and also the SSC resistance is deteriorated. Thus, in one embodiment, Cr is provided in a concentration ranging between about 0.40 to 1.5 wt. %. In a preferred embodiment, Cr is provided in a concentration ranging between about 0.40. to 1.0 wt. %.

Silicon (Si)

Si is an element that is contained within the steel and contributes to deoxidation. As Si increases resistance to temper softening of the steel, addition of Si also improves the steel's stress corrosion cracking (SSC) resistance. Notably, significantly higher Si concentrations may be detrimental to toughness and SSC resistance of the steel, as well as promoting the formation of adherent scale. In one embodiment, Si may be added in an amount ranging between about 0-0.5 wt. %. In another embodiment, the concentration of Si may range between about 0.15 to 0.40 wt. %.

Molybdenum (Mo)

As in the case of Cr, molybdenum increases the hardenability of the steel and significantly improves the steel's resis-

TABLE 1

Embodiments of steel compositions

| Range | C | Si | Mn | Cr | Mo | V | W | Cu | Al |
|---|---|---|---|---|---|---|---|---|---|
| Broad | 0.20-0.30 | 0-0.50 | 0.10-1.00 | 0.40-1.50 | 0.10-1.00 | 0.00-0.05 | 0.10-1.50 | 0.00-0.15 | 0.00-0.10 |
| Narrow | 0.20-0.30 | 0.15-0.40 | 0.20-0.50 | 0.40-1.00 | 0.30-0.80 | 0.00-0.05 | 0.20-0.60 | 0.00-0.08 | 0.020-0.070 |

| Range | Nb | Ca | Ti | P | N | S | O | B |
|---|---|---|---|---|---|---|---|---|
| Broad | 0.00-0.10 | 0-0.01 | 0-0.05 | 0-0.015 | 0.00-0.01 | 0.00-0.003 | 0-200 ppm | 0-100 ppm |
| Narrow | 0.020-0.060 | 0-0.005 | 0.01-0.030 | 0-0.010 | 0.00-0.0060 | 0.00-0.002 | 0-200 ppm | 10-30 ppm |

tance to temper softening and SSC. In addition, Mo also prevents the segregation of phosphorus (P) at grain boundaries. In one embodiment, if the Mo content is less than about 0.2 wt. %, its effect is not substantially significant. In other embodiments, if the Mo concentration exceeds about 1.5 wt. %, the effect of Mo on hardenability and response to tempering saturates and SCC resistance is deteriorated. In these cases, the excess Mo precipitates as fine, needle-like particles which can serve as crack initiating sites. Accordingly, in one embodiment, the Mo content ranges from about 0.10 to 1.0 wt. %. In a further embodiment, the Mo content ranges between about 0.3 to 0.8 wt. %.

Tungsten (W)

The addition of tungsten may increase the strength of steel, as it has a positive effect on hardenability and promotes high resistance to tempering softening. These positive effects further improve the steel's SSC resistance at a given strength level. In addition, W may provide significant improvements in high temperature oxidation resistance.

Furthermore, if a decrease of the strength of the steel by high temperature tempering is intended to be compensated with only an addition of Mo, the sulfide stress corrosion cracking (SSCC) resistance of the steel may deteriorate due to precipitation of large, needle-like Mo-carbides. W may have a similar effect as Mo on the temper softening resistance, but has the advantage that large carbides of W are more difficult to form, due to slower diffusion rate. This effect is due to the fact that the atomic weight of W is about 2. times greater than that of Mo.

At high W contents, the effect of W becomes saturated and segregations lead to deterioration of SSC resistance of quenched and tempered (QT) steels. Furthermore, the effect of W addition may be substantially insignificant for W concentrations less than about 0.2%. Thus, in one embodiment, the W content ranges between about 0.1-1.5 wt. %. In a further embodiment, the W content ranges between about 0.2-0.6 wt. %.

Boron (B)

Small additions of boron to the steel significantly increase hardenability. Additionally, the SSC cracking resistance of heavy-walled, QT pipes is improved by B addition. In one embodiment, in order to provide hardenability improvements, but substantially avoid detrimental effects, B addition is kept less than about 100 ppm. In other embodiment, about 10-30 ppm of B is present within the steel composition.

Aluminum (Al)

Aluminum contributes to deoxidation and further improves the toughness and sulfide stress cracking resistance of the steel. Al reacts with nitrogen (N) to form AlN precipitates which inhibit austenite grain growth during heat treatment and promote the formation of fine austenite grains. In certain embodiments, the deoxidization and grain refinement effects may be substantially insignificant for Al contents less than about 0.005 wt. %. Furthermore, if the Al content is excessive, the concentration of non-metallic inclusions may increase, resulting in an increase in the frequency of defects and attendant decreases in toughness. In one embodiment, the Al content ranges between about 0 to 0.10 wt. %. In other embodiments, Al content ranges between about 0.02 to 0.07 wt. %.

Titanium (Ti)

Titanium may be added in an amount which is enough to fix N as TiN. Beneficially, in the case of boron containing steels, BN formation may be avoided. This allows B to exist as solute in the steel, providing improvements in steel hardenability.

Solute Ti in the steel, such as Ti in excess of that used to form TiN, extends the non-recrystallization domain of the steel up to high deformation temperatures. For direct quenched steels, solute Ti also precipitates finely during tempering and improves the resistance of the steel to temper softening.

As the affinity of N with Ti in the steel is very large, if all N content is to be fixed to TiN, both N and Ti contents should satisfy Equation 1:

$$\text{Ti } \% > (48/14) * \text{N wt. } \% \quad \text{(Eq. 1)}$$

In one embodiment, the Ti content ranges between about 0.005 wt. % to 0.05 wt. %. In further embodiments, the Ti content ranges between about 0.01 to 0.03 wt. %. Notably, in one embodiment, if the Ti content exceeds about 0.05 wt. %, toughness of the steel may be deteriorated.

Niobium (Nb)

Solute niobium, similar to solute Ti, precipitates as very fine carbonitrides during tempering (Nb-carbonitrides) and increases the resistance of the steel to temper softening. This resistance allows the steel to be tempered at higher temperatures. Furthermore, a lower dislocation density is expected together with a higher degree of spheroidization of the Nb-carbonitride precipitates for a given strength level, which may result in the improvement of SSC resistance.

Nb-carbonitrides, which dissolve in the steel during heating at high temperature before piercing, scarcely precipitate during rolling. However, Nb-carbonitrides precipitate as fine particles during pipe cooling in still air. As the number of the fine Nb-carbonitrides particles is relatively high, they inhibit coarsening of grains and prevent excessive grain growth during austenitizing before the quenching step.

When Nb content is less than about 0.1 wt. %, the various effects as mentioned above are significant, whereas when the Nb content is more than about 0.1 wt. % both hot ductility and toughness of the steel deteriorates. Accordingly, in one embodiment, the Nb content ranges between about 0 to 0.10 wt. %. In other embodiments, the Nb content ranges between about 0.02 to 0.06%.

Vanadium (V)

When present in the steel, Vanadium precipitates in the form of very fine particles during tempering, increasing the resistance to temper softening. As a result, V may be added to facilitate attainment of high strength levels in seamless pipes, even at tempering temperatures higher than about 650° C. These high strength levels are desirable to improve the SSC cracking resistance of ultra-high strength steel pipes. Steel containing vanadium contents above about 0.1 wt. % exhibit a very steep tempering curve, reducing control over the steelmaking process. In order to increase the working window/process control of the steel, the V content is limited up to about 0.05 wt. %.

Nitrogen (N)

As the nitrogen content of the steel is reduced, the toughness and SSC cracking resistance are improved. In one embodiment, the N content is limited to not more than about 0.01 wt. %.

Phosphorus (P) and Sulfur (S)

The concentration of phosphorus and sulfur in the steel are maintained at low levels, as both P and S may promote SSCC.

P is an element generally found in steel and may be detrimental to toughness and SSC-resistance of the steel because of segregation at grain boundaries. Thus, in one embodiment, the P content is limited to not more than about 0.025 wt. %. In a further embodiment, the P content is limited to not more than about 0.015 wt. %. In order to improve SSC-cracking resistance, especially in the case of direct quenched steel, the P content is less than or equal to about 0.010 wt. %.

In one embodiment, S is limited to about 0.005 wt. % or less in order to avoid the formation of inclusions which are harmful to toughness and SSC resistance of the steel. In particular, for high SSC cracking resistance of Q&T steels manufactured by direct quenching, in one embodiment, S is limited to less than or equal to about 0.005 wt. % and P is limited to about less than or equal to about 0.010 wt. %.

Calcium (Ca)

Calcium combines with S to form sulfides and makes round the shape of inclusions, improving SSC-cracking resistance of steels. However, if the deoxidization of the steel is insufficient, the SSCC resistance of the steel can deteriorate. If the Ca content is less than about 0.001 wt. % the effect of the Ca is substantially insignificant. On the other hand, excessive amounts of Ca can cause surface defects on manufactured steel articles and lower toughness and corrosion resistance of the steel. In one embodiment, when Ca is added to the steel, its content ranges from about 0.001 to 0.01 wt. %. In further embodiments, Ca content is less than about 0.005 wt. %.

Oxygen (O)

Oxygen is generally present in steel as an impurity and can deteriorate toughness and SSCC resistance of QT steels. In one embodiment, the oxygen content is less than about 200 ppm.

Copper (Cu)

Reducing the amount of copper present in the steel inhibits the permeability of the steel to hydrogen by the forming an adherent corrosion product layer. In one embodiment, the copper content is less than about 0.15 wt. %. In further embodiments, the Cu content is less than about 0.08 wt. %.

To determine whether a composition is formulated in accordance with Equation 2, the amounts of the various elements of the composition are entered into Equation 2, in weight %, and an output of Equation 2 is calculated. Compositions which produce an output of Equation 2 which fall within the minimum and maximum range are determined to be in accordance with Equation 2. In one embodiment, the minimum and maximum values of Equation 2 vary between about 0.05-0.39 wt. %, respectively. In another embodiment, the minimum and maximum values of Equation 2 vary between about 0.10-0.26 wt. %, respectively.

Sample steel compositions in accordance with Equation 2 were manufactured at laboratory and industrial scales in order to investigate the influence of different elements and the performance of each steel chemical composition under mildly sour conditions targeting a yield strength between about 120-140 ksi.

As will be discussed in the examples below, through a proper selection of chemical composition and heat treatment conditions, high strength steels with good SSC resistance can be achieved.

Combinations of Mo, B, Cr and W are utilized to ensure high steel hardenability. Furthermore, combinations of Mo, Cr, Nb and W are utilized to develop adequate resistance to softening during tempering and to obtain adequate microstructure and precipitation features, which improve SSC resistance at high strength levels.

It may be understood that these examples are provided to further illustrate embodiments of the disclosed compositions and should in no way be construed to limit the embodiments of the present disclosure.

Table 2 illustrates three compositions formulated according to Equation 2, a low Mn—Cr variant, a V variant, and a high Nb variant (discussed in greater detail below in Example 3 as Samples 14, 15, and 16).

TABLE 2

Steel compositions in accordance with Equation 2

| Sample | C | Mn | Cr | Mo | Nb | V | W | Other |
|---|---|---|---|---|---|---|---|---|
| Base Composition (Sample 13C) | 0.25 | 0.41 | 0.98 | 0.71 | 0.024 | | | Ti, B, Al, Si |
| Low Mn—Cr Variant (Sample 14) | 0.25 | 0.26 | 0.5 | 0.74 | 0.023 | | | Ti, B, Al, Si |
| V Variant (Sample 15) | 0.25 | 0.19 | 0.5 | 0.74 | 0.022 | 0.15 | | Ti, B, Al, Si |
| High Nb Variant (Sample 16) | 0.24 | 0.2 | 0.51 | 0.73 | 0.053 | | | Ti, B, Al, Si |
| W Variant (Sample 17) | 0.25 | 0.2 | 0.53 | 0.73 | 0.031 | 0.031 | 0.021 | Ti, B, Al, Si |

EXAMPLES

Guideline Formula

An empirical formula has been developed for guiding the development of embodiments of the steel composition for sour service. Compositions may be identified according to Equation 2 in order to provide particular benefits to one or more of the properties identified above. Furthermore, compositions may be identified according to Equation 2 which possess yield strengths within the range of about 120-140 ksi (approximately 827-965 MPa).

$$\text{Min} < \text{Mo}/10+\text{Cr}/12+\text{W}/25+\text{Nb}/3+25\text{B} < \text{Max} \quad \text{(Eq. 2)}$$

In order to compare the toughness of QT steels having different strength levels, a normalized 50% FATT (fracture appearance transition temperature), referred to a selected Yield Strength value, was calculated according to Equation 3. Equation 3 is empirically derived from experimental data of FATT vs YS.

$$\frac{\Delta FATT}{\Delta YS} = 0.3^\circ \text{ C./MPa} \quad \text{(Eq. 3)}$$

In brief, yield strength and 50% FATT were measured for each sample and Equation 3 was employed to normalize the 50% FATT values to a selected value of Yield Strength, in one embodiment, about 122 ksi. Advantageously, this normalization substantially removes property variations due to yield strength, allowing analysis of other factors which play a role on the results.

Similarly, in order to compare measured $K_{ISSC}$ values of steels with different yield strength levels, normalized $K_{ISSC}$ values were calculated according to Equation 4, empirically derived from experimental data of $\Delta K_{ISSC}$ vs. $\Delta YS$.

$$\frac{\Delta K_{ISSC}}{\Delta YS} = -0.043\ m^{0.5} \quad \text{(Eq. 4)}$$

In one embodiment, the $K_{ISSC}$ values were normalized to about 122 ksi.

Figure 2:
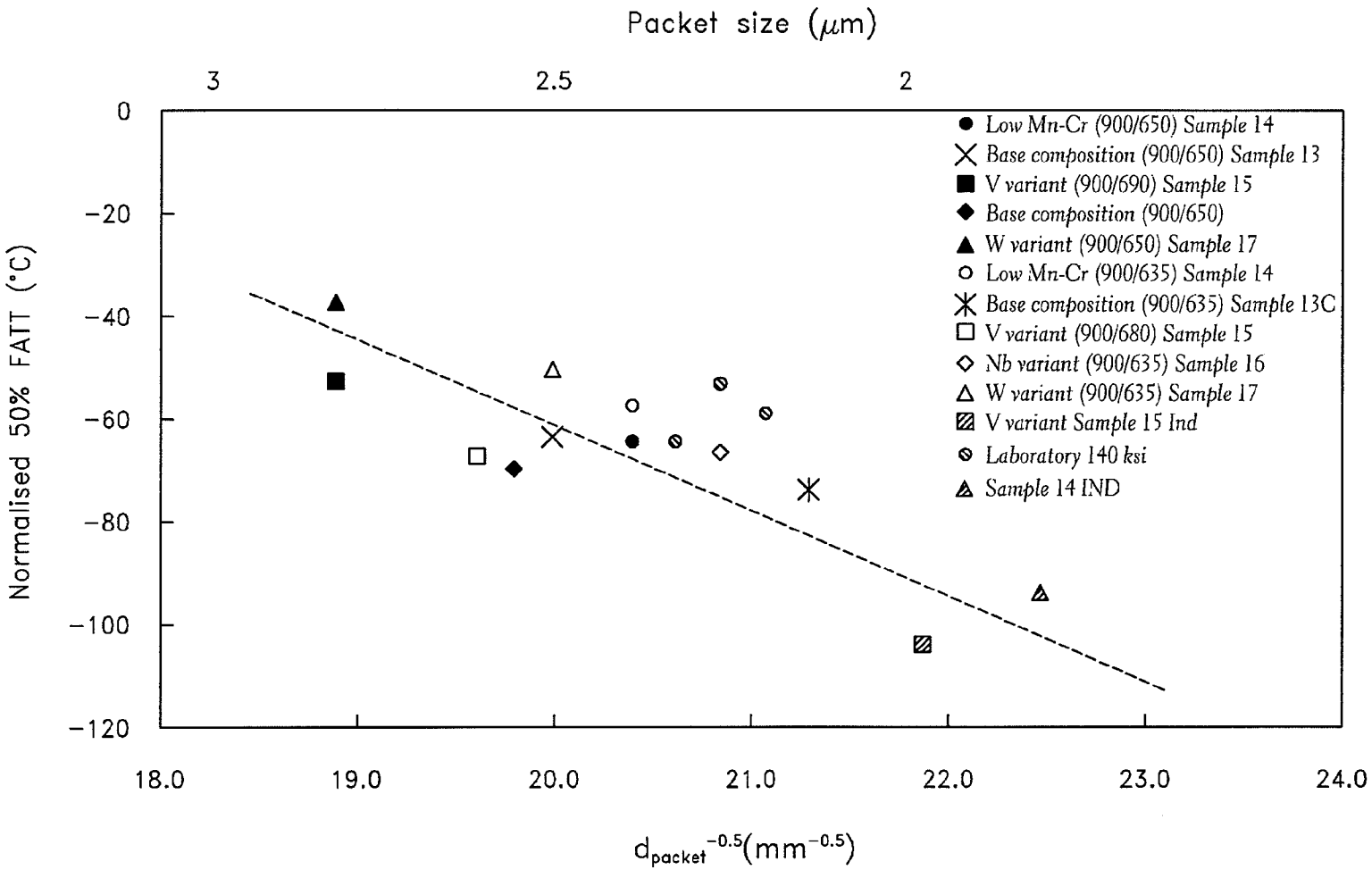
FIG. 2 presents normalized 50% FATT values (the temperature at which the fracture surface of a Charpy specimen shows 50% of ductile and 50% brittle area) as a function of packet size for embodiments of the disclosed steel compositions, illustrating improvements in normalized toughness with packet size refinement.
Figure 3:
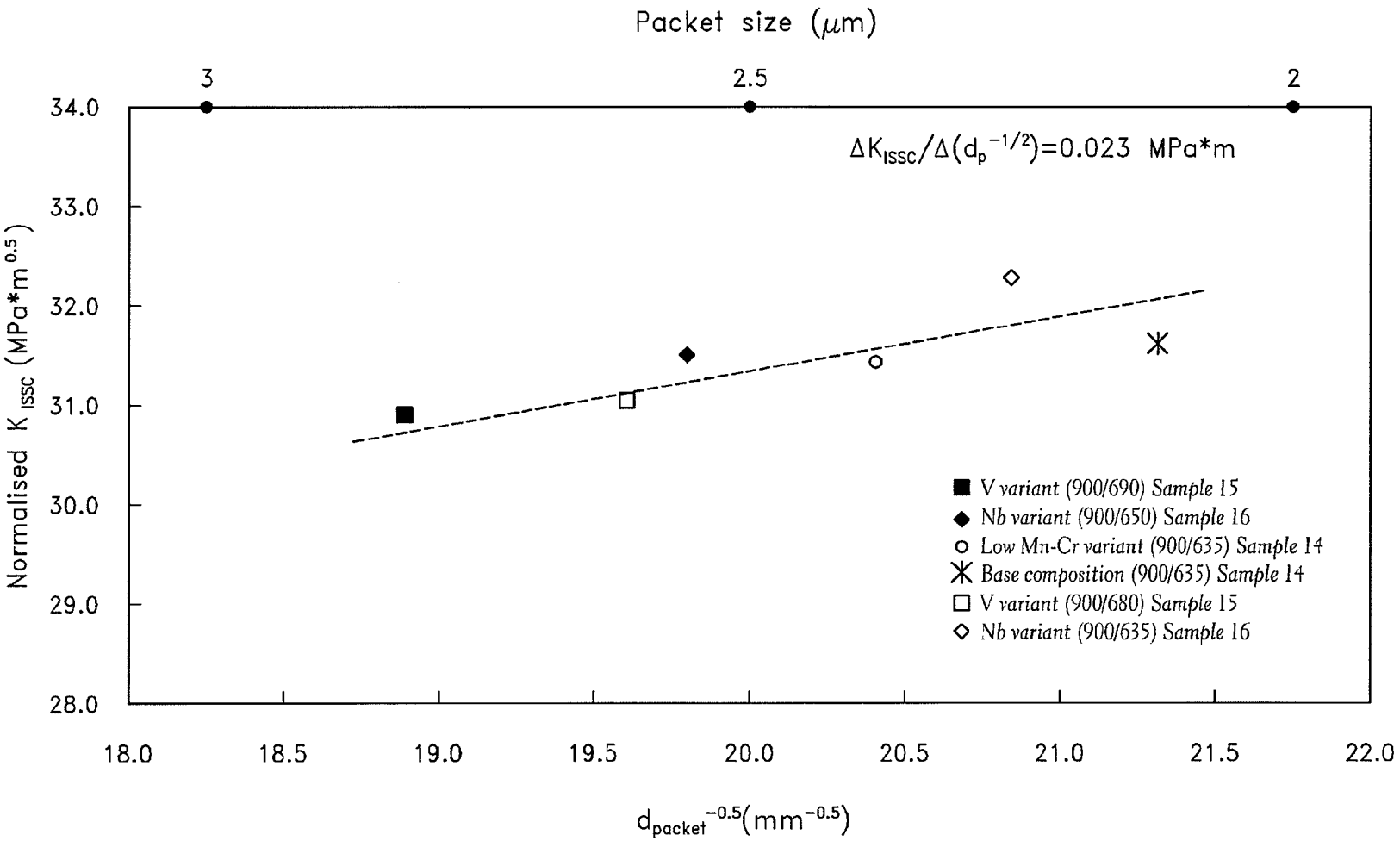
FIG. 3 presents normalized $K_{ISSC}$ as a function of packet size for embodiments of the disclosed compositions.

Both the normalized 50% FATT and normalized $K_{ISSC}$ values of embodiments of the composition were found to be related to the inverse square root of the packet size, as illustrated in FIGS. 2 and 3, respectively. These results show that both toughness, as measured by 50% FATT, and SSC resistance, as measured by $K_{ISSC}$, improve with packet size refinement.

In order to compare the precipitate morphology of Q&T materials, a shape factor parameter was measured according to Equation 5:

$$\text{Shape Factor} = 4\pi A/P^2 \quad \text{(Eq. 5)}$$

where A and P are the area of the particle and the perimeter of the particle, respectively, projected onto a plane. In one embodiment, the perimeter may be measured by a Transmission Electron Microscope (TEM) equipped with Automatic Image Analysis. The shape factor is equal to about 1 for round particles and is lower than about 1 for elongated ones Stress Corrosion Resistance Resistance to stress corrosion was examined according to NACE TM 0177-96 Method A (constant load). The results are illustrated below in Table 3. An improvement in SSC resistance was observed when precipitates with size greater than about 70 nm, such as cementite, possessed a shape factor greater than or equal to about 0.62.

TABLE 3

SSC resistance of and shape factor of steel compositions having precipitates of $d_p > 70$ nm

| Sample | Shape factor of precipitates with $d_p > 70$ nm | YS (0.2% offset) MPa | YS (0.2% offset) Ksi | Time to rupture** (hours) |
|---|---|---|---|---|
| Base composition (Sample 13C) (900/650)* | 0.64 | 849 | 123.2 | >720<br>>720 |
| High Nb variant (Sample 16) (900/650)* | 0.70 | 870 | 126.2 | >720<br>>720 |
| V variant (Sample 15) (900/690)* | 0.79 | 846 | 122.8 | >720<br>>720 |

*Austenitization and tempering temperatures, respectively, are shown in parentheses.
**about 85% SMYS load From these data and further optical microscopy, scanning electron microscopy (SEM), transmission electron microscopy (TEM), orientation imaging microscopy (OIM), and combinations thereof, it was discovered that the following microstructure and precipitation parameters are beneficial.

Average packet size of the steel, $d_{packet}$, less than about 3 μm.

Precipitates with particle diameter, $d_p$, greater than about 70 nm possessing a shape factor equal to or greater than about 0.62.

Control of Thermal Treatment

Figure 4:
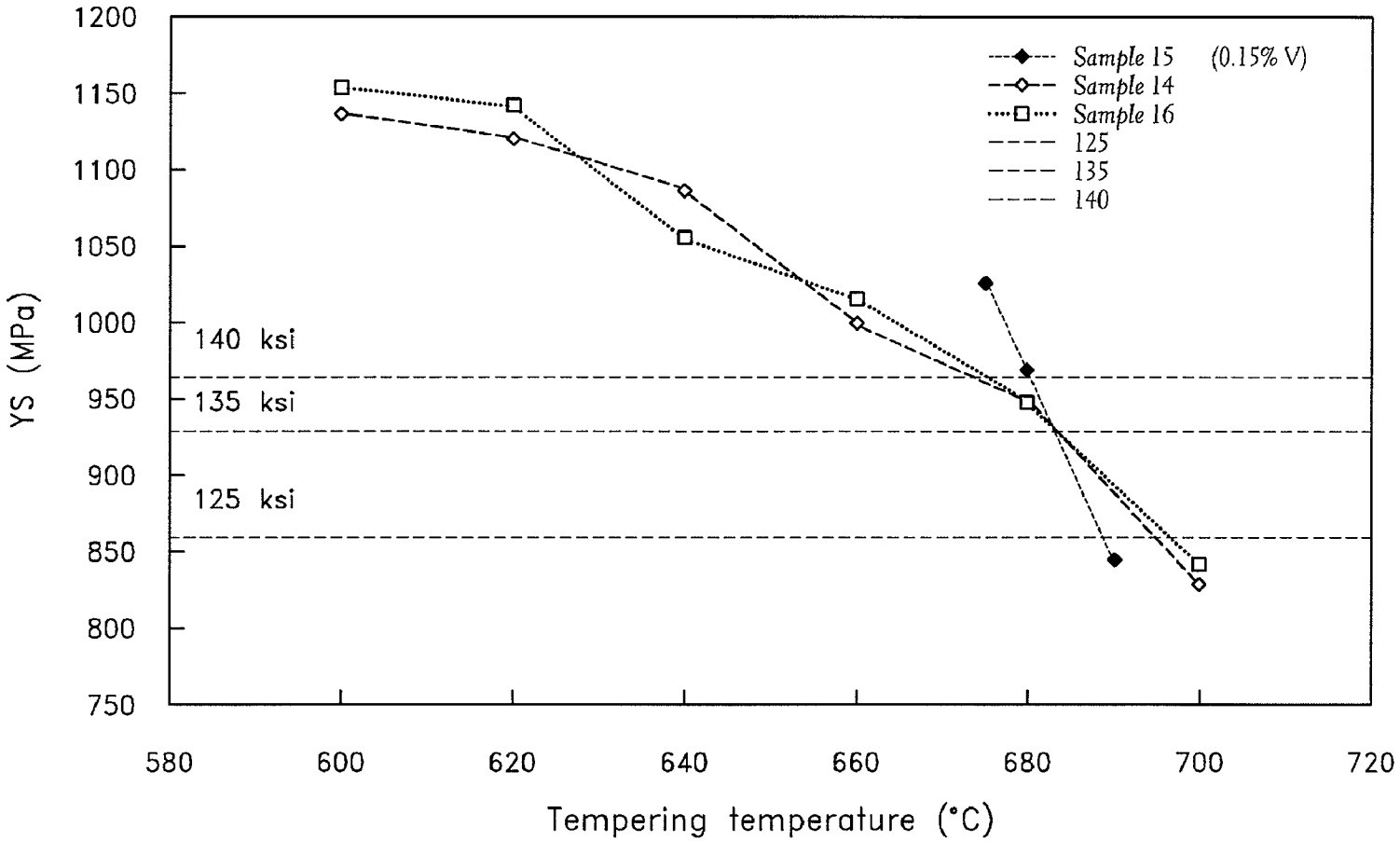
FIG. 4 presents measurements of yield strength as a function of tempering temperature for embodiments of the disclosed compositions.

Ease of the control of thermal treatment (process control) was quantified by evaluation of the slope of the yield strength versus tempering temperature behavior. Representative measurements are illustrated in Table 4 and FIG. 4.

TABLE 4

Slope of Yield Strength vs Tempering Temperature measurements

| Steel Composition | $\frac{\Delta YS}{\Delta T}$ |
|---|---|
| Base composition (Sample 13C) | −6 MPa/° C |
| Low Mn-Cr Variant (Sample 14) | −4 MPa/° C |
| V Variant (Sample 15) | −12 MPa/° C |
| High Nb Variant (Sample 16) | −6.7 MPa/° C |

According to Table 4, vanadium content produces a high slope in the yield stress-temperature curve, indicating that it is difficult to reach a good process control in vanadium containing steel compositions.

The steel composition with low V content (Mn—Cr variant) provides tempering curve which is less steep than other compositions examined, indicating improved process control capability, while also achieving high yield strength.

Example 1

Influence of Copper Content on the Formation of a Protective Layer Against Hydrogen Uptake a) Materials Chemical compositions of certain embodiments of the steel composition are depicted in Table 5. Four types of medium carbon (about 0.22-0.26 wt. %) steels with Ti, Nb, V, additions, among others, were examined. The compositions differ mainly in copper and molybdenum additions.

TABLE 5

Compositions investigated in Example 1

| Sample | C | Cr | Mo | Mn | Si | P | S | Cu | Other |
|---|---|---|---|---|---|---|---|---|---|
| 1 | 0.25 | 0.93 | 0.45 | 0.43 | 0.31 | 0.007 | 0.006 | 0.02 | Ti, Nb, B |
| 2 | 0.27 | 1.00 | 0.48 | 0.57 | 0.24 | 0.009 | 0.002 | 0.14 | Ti, Nb, B |
| 3 | 0.22-0.23 | 0.96-0.97 | 0.66-0.73 | 0.38-0.42 | 0.19-0.21 | 0.006-0.009 | 0.001 | 0.04-0.05 | Ti, Nb, B |
| 4 | 0.24-0.26 | 0.90-0.95 | 0.67-0.69 | 0.50 | 0.22-0.30 | 0.011-0.017 | 0.001-0.002 | 0.15-0.17 | Ti, Nb, B |
| 5 | 0.25 | 1.00-1.02 | 0.70-0.71 | 0.31-0.32 | 0.21 | | | 0.09 | Ti, Nb, V, B |

Sample 1 0.02Cu-0.45Mo; low Cu, low Mo
Sample 2 0.14Cu-0.48Mo; high Cu; low Mo
Sample 3 0.04Cu-0.70Mo; low Cu; high Mo
Sample 4 0.16Cu-0.68Mo; high Cu, high Mo b) Microstructure and Corrosion Product Characterization The microstructures of samples 1-4 were examined through scanning electron microscopy (SEM) and X-Ray diffraction at varying levels of pH. The results of these observations are discussed below.

pH 2.7, SEM Observations

Two layers of corrosion products were generally observed. One layer observed near the steel surface was denoted the internal layer, and another layer observed on the top of the internal layer was denoted the external layer.

The internal layer was rich in alloying elements and comprised non-stoichometrically alloyed FeS, [(Fe, Mo, Cr, Mn, Cu, Ni, Na)z(S,O)x], The external layer comprised sulfide crystals with polygonal morphologies; Fe+S or Fe+S+O.

It was further observed that the higher the Cu content present in the steel, the lower the S:O ratio and the lower the adherence of the corrosion products.

The sulfide compounds formed were not highly protective.

pH 2.7, X-Ray Observations

The internal layer was identified by X-Ray analysis as mackinawite (tetragonal FeS)

Approaching the steel surface, a higher fraction of tetragonal FeS was observed.

The lower the S:O ratio present in the sulfide corrosion product, the higher the Cu content in the steel, and the higher the fraction of cubic FeS. Cubic FeS was related to higher corrosion rates.

pH 4.3, X-Ray Observations

Only mackinawite adherent layer was observed. The external cubic sulfide crystals were not observed.

c) Hydrogen Permeation

As the Cu concentration increased in the steel, the S:O ratio in mackinawite layer was reduced, making the layer more porous.

The H subsurface concentration also increased as a result.

d) Weight Loss

Weight loss was observed at about pH 2.7 and 4.3 in the steels.

e) Preliminary Conclusions

Internal and external corrosion products of mackinawite and cubic FeS, respectively were formed.

The internal layer of mackinawite was first formed from solid state reaction, resulting in the presence of steel alloying elements in this layer.

Fe(II) was transported through the mackinawite layer and reprecipitated as tetragonal and cubic FeS.

In more aggressive environments, such as pH 2.7, cubic sulfide precipitates.

Higher Cu concentrations resulted in a more permeable mackinawite layer, resulting in increased H uptake.

Thus, it has been determined that there are least two factors which drive the increased corrosion observed with increased Cu (lower S:O): (a) the low adherence of the corrosion product which resulted in a relatively poor corrosion layer barrier to further corrosion and (b) the increase in porosity in the mackinawite, which allowed an increase in the subsurface H concentration.

f) Mechanical Characterization—Sulfide Stress Cracking Resistance

For a given yield strength and microstructure, steels with low Cu content exhibited a higher corrosion resistance, $K_{ISSC}$, due to the formation of an adherent corrosion product layer that reduced hydrogen subsurface concentration.

Example 2

Influence of W Content on High Temperature Oxidation Resistance

Grain growth, tempering resistance, cementite shape factor, oxidation resistance, and corrosion resistance were examined in samples 6C-9, outlined below in Table 6.

a) Materials:

TABLE 6

Compositions investigated in Example 2

| Sample | C | Mn | Si | Ni | Cr | Mo | W | Cu | P | Al | Ti |
|---|---|---|---|---|---|---|---|---|---|---|---|
| 6C | 0.24 | 1.50 | 0.23 | 0.12 | 0.26 | 0.10 | | 0.12 | | 0.020 | 0.020 |
| 7 | 0.24 | 1.45 | 0.22 | 0.09 | 0.31 | 0.03 | | 0.14 | | 0.017 | 0.017 |

TABLE 6-continued

| | | | | | | | | | | | |
|---|---|---|---|---|---|---|---|---|---|---|---|
| 8 | 0.23 | 1.44 | 0.24 | 0.10 | 0.27 | 0.03 | 0.20 | 0.12 | 95 | 0.026 | 0.018 |
| 9 | 0.24 | 1.42 | 0.26 | 0.11 | 0.28 | 0.02 | 0.40 | 0.13 | 100 | 0.028 | 0.018 |

Sample 6C Baseline composition
Sample 7 Baseline composition with lower Mo
Sample 8 Baseline composition with 0.2 wt. % W replacing Mo
Sample 9 Baseline composition with 0.4 wt. % W replacing Mo b) Grain Growth (SEM)

Substantially no differences were detected in the grain size after austenitisation within the temperature range of about 920-1050° C., indicating that grain size is substantially independent of W content.

c) Tempering Resistance

Substantially no effect on tempering resistance, measured in terms of hardness evolution as a function of tempering temperature, was observed.

d) Cementite Shape Factor

Substantially no effect was detected on the shape factor of cementite or other precipitates which would affect SSC resistance.

e) Oxidation Resistance

An improvement in the oxidation resistance, both in 9% $CO_2$+18% $H_2O$+3% $O_2$. and 9% $CO_2$+18% $H_2O$+6% $O_2$ atmospheres in the temperature range of about 1200° C.-1340° C. was detected in compositions containing W.

Each of Samples 8 and 9 demonstrated less weight gain, and therefore, less oxidation, than baseline Sample 6C.

W addition decreased the amount of fayalite at equilibrium conditions, and hence, oxidation kinetics. It is expected that W addition to the steels should facilitate the descaling process, retarding the formation of fayalite.

f) Corrosion Resistance

W addition may provide corrosion resistance.

Both of Samples 8 and 9 demonstrated improved resistance to pitting corrosion compared with Sample 6C.

Example 3

Microstructure and Mechanical Characterization of Further Steel Compositions for Sour Service Microstructural examination (SEM), hardness, yield strength, toughness as a function of packet size, precipitation and $K_{ISSC}$ were examined in Samples 13C-16, outlined below in Table 7.

a) Materials

TABLE 7

Compositions investigated in Example 3

| Sample | C | Mn | Cr | Mo | Nb | V | W | Other |
|---|---|---|---|---|---|---|---|---|
| 13C | 0.25 | 0.41 | 0.98 | 0.71 | 0.024 | | | Ti, B, Al, Si |
| 14 | 0.25 | 0.26 | 0.5 | 0.74 | 0.023 | | | Ti, B, Al, Si |
| 15 | 0.25 | 0.19 | 0.5 | 0.74 | 0.022 | 0.15 | | Ti, B, Al, Si |
| 16 | 0.24 | 0.2 | 0.51 | 0.73 | 0.053 | | | Ti, B, Al, Si |
| 17 | 0.25 | 0.2 | 0.53 | 0.73 | 0.031 | 0.031 | 0.021 | Ti, B, Al, Si |

Sample 13C Baseline composition
Sample 14 Composition incorporates a decrease in Mn and Cr
Sample 15 Composition incorporates V to induce high precipitation hardening
Sample 16 Composition incorporates high Nb to induce high precipitation hardening
Sample 17 Composition incorporating W In certain embodiments, samples were subjected to a hot rolling treatment intended to simulate industrial processing.

b) Microscopy

Orientation imaging microscopy was performed to probe the microstructure of the quenched steels.

All quenched and tempered compositions exhibited substantially fully martensitic microstructures after quenching, with packet sizes ranging between about 2.2 to 2.8 μm.

Similar packet size may be achieved for different chemical compositions by changing the heat treatment process.

When the compositions are quenched, martensite is formed inside each austenite grain. Inside each grain martensite, packets can be identified by looking to the orientation of martensite (similar to forming a subgrain). When neighboring packets have very different orientation, they behave similar to a grain boundary, making the propagation of a crack more difficult. Thus, these samples demonstrate higher $K_{ISSC}$ values and a lower Charpy transition temperatures.

c) Hardness

Higher tempering temperatures were required in order to achieve a given hardness in the V variant composition (Sample 15), due to precipitation hardening. However, a steeper tempering curve for this composition complicated process control (See Table 5).

d) Yield Strength

Steels were heat treated in order to obtain "high" and "low" yield strengths.

Limited V content was found to be significant, as V was determined to make the steel very sensitive to tempering temperature.

e) Toughness Vs. Packet Size

50% FATT increased with packet size.

The $K_{ISSC}$ improved with packet size refinement, in a roughly linear manner (FIG. 3).

f) Precipitation (Samples 13C, 15, 16)

Average precipitate size was comparable for the baseline composition (13C) and Nb composition (Sample 16), while approximately one half less in the V composition (Sample 15), which explains the resistance to tempering and the tempering curve slope.

Higher values of shape factor were measured in Samples 15 and 16, compared with Sample 13C.

g) Sulfide Stress Cracking Resistance $K_{ISSC}$ values measured in Samples 13C, 14, 15, and 16 were plotted against yield strength (FIG. 1) to examine the relation of these properties.

A good correlation was observed between $K_{ISSC}$ and yield strength. The higher the YS, the lower the $K_{ISSC}$.

There appears to be substantially no statistical difference in sulfide stress cracking resistance, for a given yield strength, with changes on steel composition. This observation appears to be due to the similarities in final microstructure (grain refinement, packet size, precipitates shape and distribution).

When samples with yield strengths of about 122 to 127 ksi (approximately 841 to 876 MPa) were loaded to stress levels of about 85% of SMYS, the V and Nb compositions survived without failure over about 720 hours.

Example 4

Influence of Microstructure on Hydrogen Diffusivity

Tempering curves were measured for yield strength and hardness as a function of tempering temperature are examined in samples 10C-12, outlined below in Table 8. Hydrogen permeation was further examined.

a) Materials

TABLE 8

Compositions of Example 4

| Sample | C | Mn | Si | Ni | Cr | Mo | V | Cu | Ti | Nb | N* | O* | S* | P* |
|---|---|---|---|---|---|---|---|---|---|---|---|---|---|---|
| 10C | 0.22 | 0.26 | | | 0.50 | 0.75 | | | | 0.023 | | | | |
| 11 | 0.22 | 0.26 | 0.23 | 0.06 | 0.10 | 0.75 | 0.120 | 0.08 | 0.015 | 0.04 | 45 | 17 | 20 | 80 |
| 12 | 0.22 | 0.40 | 0.26 | 0.03 | 0.98 | 0.73 | 0.003 | 0.05 | 0.012 | 0.03 | 37 | 13 | 10 | 90 |

*concentration in ppm
Sample 10C Baseline composition
Sample 11 Composition high in V
Sample 12 Composition high in Cr b) Tempering Curve (Samples 10, 11)

The high V material (Sample 11) exhibited a very steep tempering curve (measured as Yield Strength and hardness vs. temperature).

The limitation of V content improved the heat treatment process control.

c) Hydrogen Permeation (Samples 9, 10, 11)

For a given yield stress, the H trapping ability was comparable for the three steels.

Similarly, for a given yield stress, the reversible H detrapping ability was comparable for the three steels Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A steel composition, comprising:

carbon (C) between about 0.2 and 0.3 wt. %;

manganese (Mn) between about 0.1 and 1 wt. %;

silicon (Si) between about 0 and 0.5 wt. %;

chromium (Cr) between about 0.4 and 1.5 wt. %;

molybdenum (Mo) between about 0.1 and 1 wt. %;

niobium (Nb) between about 0 and 0.1 wt. %;

aluminum (Al) between about 0 and 0.1 wt. %;

calcium (Ca) between about 0 and 0.01 wt. %;

boron (B) less than about 100 ppm;

titanium (Ti) between about 0 and 0.05 wt. %;

tungsten (W) between about 0.1 and 1.5 wt. %;

vanadium (V) between about 0 and no more than about 0.05 wt. %;

copper (Cu) between about 0 and no more than about 0.15 wt. %;

oxygen (O) less than about 200 ppm;

nitrogen (N) less than about 0.01 wt. %;

sulfur (S) less than about 0.003 wt. %; and phosphorus (P) less than about 0.015 wt. %;

wherein the average packet size, $d_{packet}$ of the steel composition, the precipitate size of the steel composition, and the shape factor of the precipitates are selected to improve the sulfur stress corrosion resistance of the composition;

wherein the average packet size, $d_{packet}$ of the steel composition is less than about 3 μm;

wherein the composition possesses precipitates having a particle diameter, $d_p$, greater than about 70 nm and which possess an average shape factor of greater than or equal to about 0.62; and wherein the shape factor is calculated according to $4A\pi/P^2$, where A is area of the particle projection and P is the perimeter of the particle projection.

2. The steel composition of claim 1, wherein the steel composition satisfies the equation Mo/10+Cr/12+W/25+Nb/3+25*B between about 0.05 wt. % and 0.39 wt. %.

3. The steel composition of claim 1, wherein the yield stress of the steel composition ranges between about 120 to 140 ksi.

4. The steel composition of claim 1, wherein the sulfur stress corrosion (SSC) resistance of the composition is about 720 h as determined by testing in accordance with NACE TM0177, test Method A, at stresses of about 85% Specified Minimum Yield Strength (SMYS) for full size specimens.

5. The steel composition of claim 1, comprising:

carbon (C) between about 0.2 and 0.3 wt. %;

manganese (Mn) between about 0.2 and 0.5 wt. %;

silicon (Si) between about 0.15 and 0.4 wt. %;

chromium (Cr) between about 0.4 and 1 wt. %;

molybdenum (Mo) between about 0.3 and 0.8 wt. %;

niobium (Nb) between about 0.02 and 0.06 wt. %;

aluminum (Al) between about 0.02 and 0.07 wt. %;

calcium (Ca) between about 0 and 0.01 wt. %;

boron (B) between about 10 and 30 ppm;

titanium (Ti) between about 0.1 and 0.03 wt. %;

tungsten (W) between about 0.2 and 0.6 wt. %;

vanadium (V) between about 0 and no more than about 0.05 wt. %;

copper (Cu) between about 0 and no more than about 0.08 wt. %;

oxygen (O) less than about 200 ppm;

nitrogen (N) less than about 0.01 wt. %;

sulfur (S) less than about 0.002 wt. %; and phosphorus (P) less than about 0.010 wt. %.

6. The steel composition of claim 1, wherein the steel is formed into a pipe.

7. A steel composition, comprising:

carbon (C), molybdenum (Mo), chromium (Cr), tungsten (W), niobium (Nb), and boron (B);

the amount of each of the elements provided, in wt. % of the total steel composition, such that the steel composition satisfies the formula:

Mo/10+Cr/12+W/25+Nb/3+25*B between about 0.05 and 0.39 wt. %;

wherein the average packet size, $d_{packet}$ of the steel composition, the precipitate size of the steel composition, and the shape factor of the precipitates are selected to improve the sulfur stress corrosion resistance of the composition;

wherein the average packet size, $d_{packet}$ of the steel composition is less than about 3μm;

wherein the composition possesses precipitates having a particle diameter, $d_p$, greater than about 70 nm and which possess an average shape factor of greater than or equal to about 0.62; and wherein the shape factor is calculated according to $4A\pi/P^2$, where A is area of the particle projection and P is the perimeter of the particle projection.

8. The steel composition of claim 7, wherein the steel composition satisfies the equation Mo/10+Cr/12+W/25+Nb/3+25*B between about 0.10 wt. % and 0.26 wt. %.

9. The steel composition of claim 7, wherein the steel composition exhibits a substantially linear relationship between mode I sulfide stress corrosion cracking toughness ($K_{ISSC}$) and yield strength.

10. The steel composition of claim 7, wherein the microstructure of the steel composition comprises greater than about 95 vol. % martensite and less than about 5 vol. % bainite, on the basis of the total volume of the steel composition.

11. The steel composition of claim 7, comprising:

carbon (C) between about 0.2 and 0.3 wt. %;

chromium (Cr) between about 0.4 and 1 wt. %;

molybdenum (Mo) between about 0.3 and 0.8 wt. %;

niobium (Nb) between about 0.02 and 0.06 wt. %;

boron (B) 10 to 30 ppm;

tungsten (W) between about 0.2 and 0.6 wt. %;

on the basis of the total weight of the steel composition.

12. The steel composition of claim 11, further comprising:

manganese (Mn) between about 0.2 and 0.5 wt. %;

silicon (Si) between about 0.15 and 0.4 wt. %;

aluminum (Al) between about 0.02 and 0.07 wt. %;

calcium (Ca) between about 0 and 0.005 wt. %;

titanium (Ti) between about 0.01 and 0.03 wt. %;

vanadium (V) between about 0 and no more than about 0.05 wt. %;

copper (Cu) between about 0 and no more than about 0.15 wt. %;

oxygen (O) less than about 200 ppm;

nitrogen (N) less than about 0.006 wt. %;

sulfur (S) less than about 0.002 wt. %; and phosphorus (P) less than about 0.01 wt. %.

13. A steel composition, comprising:

carbon (C) between about 0.2 and 0.3 wt. %;

manganese (Mn) between about 0.1 and 1 wt. %;

chromium (Cr) between about 0.4 and 1.5 wt. %;

silicon (Si) between about 0.15 and 0.5 wt. %;

molybdenum (Mo) between about 0.1 and 1 wt. %;

tungsten (W) between about 0.1 and 1.5 wt. %;

niobium (Nb) between about 0 and 0.1 wt. %; and boron (B) less than about 100 ppm;

wherein the average packet size, $d_{packet}$ of the steel composition, the precipitate size of the steel composition, and the shape factor of the precipitates are selected to improve the sulfur stress corrosion resistance of the composition;

wherein the average packet size, $d_{packet}$ of the steel composition is less than about 3 μm;

wherein the composition possesses precipitates having a particle diameter, $d_p$, greater than about 70 nm and which possess an average shape factor of greater than or equal to about 0.62; and wherein the shape factor is calculated according to $4A\pi/P^2$, where A is area of the particle projection and P is the perimeter of the particle projection.

14. The steel composition of claim 13, further comprising aluminum (Al) up to about 0.1 wt. %.

15. The steel composition of claim 13, further comprising titanium (Ti) up to about 0.05 wt. %.

16. The steel composition of claim 13, further comprising vanadium (V) up to about 0.05 wt. %.

17. The steel composition of claim 13, further comprising nitrogen (N) less than about 0.01 wt. %.

18. The steel composition of claim 13, wherein the resulting steel has a yield strength between 120 to 140 ksi.

19. The steel composition of claim 13, wherein the sulfur stress corrosion (SSC) resistance of the composition is about 720 h as determined by testing in accordance with NACE TM0177, test Method A, at stresses of about 85% Specified Minimum Yield Strength (SMYS) for full size specimens.

* * * * *

UNITED STATES PATENT AND TRADEMARK OFFICE

CERTIFICATE OF CORRECTION

PATENT NO. : 7,862,667 B2
APPLICATION NO. : 12/042145
DATED : January 4, 2011
INVENTOR(S) : Turconi et al.

It is certified that error appears in the above-identified patent and that said Letters Patent is hereby corrected as shown below:

On the Title Page at Item (56), Page 2, Column 2, Line 55, under Other Publications, change "J. lnorg." to --J. Inorg.--.

In Column 3, Line 19, change "95." to --95--.

In Column 4, Line 37, change "0.40." to --0.40--.

In Column 13, Line 26, change "$O_2$." to --$O_2$--.

In Column 16, Line 55, In Claim 5, change "0.1" to --0.01--.

In Column 17, Line 3, In Claim 7, change "(B);" to --(B),--.

Signed and Sealed this
Eleventh Day of October, 2011

David J. Kappos

David J. Kappos
*Director of the United States Patent and Trademark Office*